US005617477A

United States Patent [19]

Boyden

[11] Patent Number: 5,617,477

[45] Date of Patent: Apr. 1, 1997

[54] PERSONAL WEARABLE COMMUNICATION SYSTEM WITH ENHANCED LOW FREQUENCY RESPONSE

[75] Inventor: James H. Boyden, Los Altos Hills, Calif.

[73] Assignee: Interval Research Corporation, Palo Alto, Calif.

[21] Appl. No.: 400,901

[22] Filed: Mar. 8, 1995

[51] Int. Cl.[6] ..... H04R 5/02

[52] U.S. Cl. ..... 381/25; 381/183; 381/74

[58] Field of Search ..... 381/24, 25, 183, 381/187, 74

[56] References Cited

U.S. PATENT DOCUMENTS

| | | | |
|---|---|---|---|
| 3,894,196 | 7/1975 | Briskey . | |
| 4,110,583 | 8/1978 | Lepper | 381/25 |
| 4,490,842 | 12/1984 | Watanabe . | |
| 5,022,486 | 6/1991 | Miura et al. | 381/187 |
| 5,138,663 | 8/1992 | Moseley | 381/71 |
| 5,459,290 | 10/1995 | Yamagishi | 381/183 |

*Primary Examiner*—Forester W. Isen
*Attorney, Agent, or Firm*—Brooks & Kushman P.C.

[57] ABSTRACT

A personal wearable portable communication and entertainment system which provides improved quality audio response and which does not interfere with the wearer's activities or block environmental sounds is disclosed. Transducers or speakers, which preferably are provided in arrayed pairs, are situated in a wearable structure, such as a garment for the wearer's torso or a headband for the wearer's head. The transducers are positioned on opposite sides of the wearer's torso or head, adjacent the ears. In one embodiment, the transducers share a common closed enclosure and are driven 180° out of phase, so that back pressures cancel. In another embodiment, two hollow enclosures are provided, each with its own transducer and acoustic aperture. In a further embodiment, the transducers are positioned in a common hollow enclosure with at least one acoustic aperture between them. The speaker system is connected to or in communication with a conventional source of audio signals, such as a radio, tape player, CD player, cellular telephone or the like. With the invention, low frequency response in particular is enhanced.

114 Claims, 4 Drawing Sheets

PERSONAL WEARABLE COMMUNICATION SYSTEM WITH ENHANCED LOW FREQUENCY RESPONSE

TECHNICAL FIELD

The present invention relates to portable entertainment and personal communication systems, particularly wearable audio systems.

BACKGROUND OF THE INVENTION

There are many situations where it is desirable to provide audio output for personal use to be worn or carried near the body. This audio output could be used for portable entertainment, personal communications, and the like. These personal and portable communication and entertainment products include, for example, cellular and portable telephones, radios, tape players, and audio portions of portable video systems and personal monitors.

The audio output for many of these systems is typically directed to the wearer through the use of transducers physically positioned in the ear or covering the ear, such as earphones and headphones. Earphones and headphones, however, are often uncomfortable to use for long periods of time. Also, they can block or attenuate environmental sounds causing the wearer to lose contact with the surroundings. In this regard, this can compromise safety considerations if the wearer is engaging in activities such as running, driving a vehicle or operating machinery.

One common use of audio systems with earphones and headphones involves exercise and athletic events. It is quite common to see people running or exercising with headphones or earphones positioned in or covering their ears. Not only is this dangerous since the person often loses contact with external sounds and surroundings, but the earphones and headphones are subject to being dislodged as a result of the activity. Moreover, perspiration and inclement weather could affect the integrity of the speakers and audio system.

It is commonly desired to provide stereo audio output from these portable entertainment and personal communication systems. Also, a stereo audio output may be provided without earphones or headphones by arranging small loud speakers (a/k/a transducers) on the body. The speakers, however, are not able to create broad-band high fidelity sound, particularly in the low frequency ranges. In this regard, loud speaker transducers are usually mounted in enclosures to confine the acoustic radiation from the rear portions of the transducer so that the radiation does not combine with out-of-phase radiation from the front portions of the transducer. Without such an enclosure, there is a significant reduction of net radiated intensity, especially in the low frequency audio ranges.

For wearable speakers, the requirement of an enclosure creates a problem. In general, the volume of the enclosure will be quite small and its acoustic stiffness will dominate the speaker behavior. The result will be a high resonance frequency and consequently a poor low frequency response.

SUMMARY OF THE INVENTION

It is an object of the present invention to provide an improved audio system for portable entertainment and personal communication systems. It is another object of the present invention to provide a portable audio system which provides high quality sound, particularly at low audio frequencies.

It is another object of the present invention to provide a wearable audio system which can be easily worn and does not interfere with the person's activity, whether sports related or otherwise. It is a still further object of the present invention to provide a wearable audio system which does not require the speakers to be positioned in or covering the wearer's ears and thus overcome a number of the problems and drawbacks with present systems.

The present invention fulfills these objects and overcomes the problems with known systems by providing a personal audio system which provides high quality sound at all audio frequencies and a wearable configuration which does not interfere with the person's activity and does not block environmental sounds. In accordance with the present invention, portable speakers are provided which are wearable on the person's body and provide sounds to the ears without the necessity of actually being positioned in or covering the ears.

The present invention utilizes one or more speakers positioned on opposite sides of the wearer's head each emitting sounds which can be heard by both ears. The invention uses the unique combination of the radiation characteristics of dipole (doublet) sources with certain placement of the transducers on the body.

There are two basic embodiments of the present invention. In a first embodiment ("Type I") the transducers are coupled together in one common sealed enclosure and driven 180° out-of-phase at low frequencies. One, two or more transducers could be utilized, as desired. Since the transducers share a common enclosure, the back pressures cancel and the transducers behave as though they were individually mounted on an infinite volume enclosure. This enhances the low frequency response to the wearer's ears.

In the second embodiment ("Type II"), two enclosures are provided, each open at one end or having a vent to the atmosphere. A single transducer is mounted in each enclosure and enclosures are positioned on the shoulders or lapel of the wearer, such that the primary source, i.e. the transducer, and the vent are placed respectively at substantially different distances from the ear of the wearer, thus minimizing the cancellation of sound from the two sources which are 180° out of phase. Further, for best results one end should be placed as close to an ear as possible, consistent with the desired wearable configuration.

In either embodiment, the enclosures can be hollow or filled with an acoustically transparent material, such as open-cell foam. The enclosures also could be integrated into various types of clothing, such as vests, jackets, shirts or shawls in order to meet the needs of fashion or to serve multiple purposes such as for carrying additional items. The invention has a wide variety of business, social and personal uses.

For sports-related and other activities, it may be preferred to position the transducers of either embodiment in a headband wearable on the wearer's head. The audio signal could be generated by a radio, CD, cellular telephone, portable telephone, cassette tape, etc., or any other conventional communication system. It is also possible to position the transducers in a cap, hat or helmet of some type which is wearable for the activity. The headband or the like preferably has an open-cell foam core, may contain one or more electronics modules, and positions the transducers adjacent or above the wearer's ears. In the Type I embodiment, internal coupling between the transducers, driven 180° out-of-phase at the two ears, sets up the "dipole" operation which enhances low frequency response. In the Type II embodiment, the two open-ended enclosures, each with its own transducer, provides a similar "dipole" operation.

The headband can be sealed by a thin diaphragm such as plastic film to protect electrical components and the foam core, and also can be covered with a terry cloth-type or similar material for comfort and moisture absorbability. Other forms of the headband or wearable apparatus could be utilized, depending on the activity, aesthetic effect and/or fashion design desired.

These and other objects, features and advantages of the present invention will become apparent from the following description of the invention when viewed in accordance with the attached drawings and appended claims.

BEST MODE(S) FOR CARRYING OUT THE INVENTION

For portable entertainment and personal communication systems, it is desirable to utilize frequencies below about 80 Hz in order to achieve high fidelity performance. This is comparable to what is commonly available from inexpensive earphones. Systems with small speakers of conventional design whose size is suitable for wearing are unsatisfactory for this purpose. Also, compensating techniques such as vented "bass reflex" enclosures cannot be used for this purpose. In small enclosures, the stiffness of the air in the sealed enclosure will dominate the behavior of the system.

It is known that loud speaker transducers should be mounted in enclosures to confine the acoustic radiation from the rear portions or surface of the transducer so that it does not combine with the out-of-phase radiation from the front portions or surface. If the two radiations combine, a large reduction of net radiated intensity results, especially at low frequencies.

The combination of transducer and enclosure behaves like a high pass filter whose turnover frequency depends on several system parameters. These parameters include the free-space resonant frequency of the transducer, and the volume "V" of the sealed enclosure which acts to produce a restoring force for the diaphragm of the transducer. For small enclosures, such as those which might be worn on the body, the enclosure stiffness is likely to dominate the system. The system resonance in this region varies approximately as $\sqrt{1/V}$ and the low frequency turnover point becomes unacceptably high. For example, an enclosure whose dimensions are 10 cm×5 cm×1 cm would produce a turnover frequency on the order of 600 Hz. Acoustical radiation below that frequency falls at a rate of 12 dB per octave for constant input. At 60 Hz, for example, the radiation is reduced by 40 db with respect to that above 600 Hz.

Figure 1:
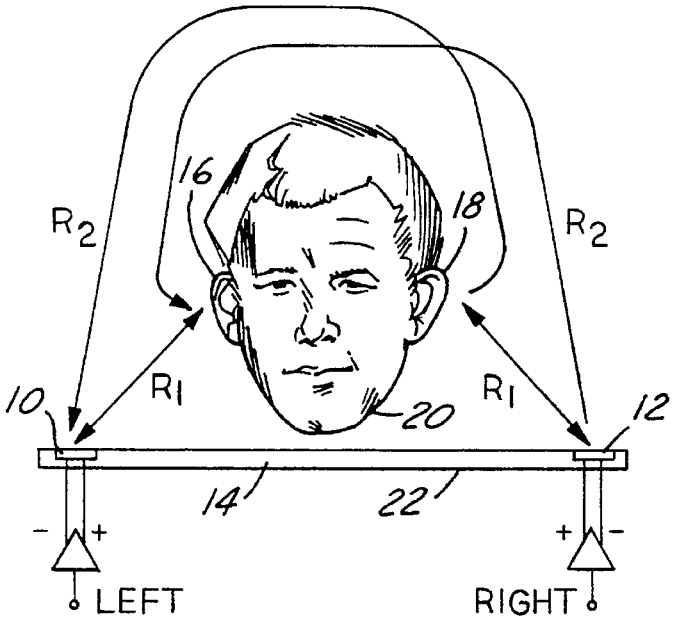
FIG. 1 illustrates the use of a first embodiment of the present invention which utilizes a single closed enclosure.

In accordance with a first preferred embodiment of the present invention ("Type I"), a pair of transducers are provided which share a common enclosure. As shown in FIG. 1, the transducers 10 and 12 are positioned at the opposite end of a common closed or sealed enclosure 14. The transducers 10 and 12 are positioned on opposite sides of the wearer's head 20 and adjacent to the wearer's ears 16 and 18, respectively.

The distance $R_1$ from transducer 10 to the closest ear 16 of the wearer is much less than the distance $R_2$ from the out-of-phase transducer to that same ear. This results in a net amplitude at the ear 16 which is comparable to that from transducer 10 alone.

Since the two transducers 10 and 12 share a common enclosure, the back pressures cancel and the transducers behave individually as though they were mounted in an infinite volume enclosure, and are driven 180° out of phase. As a result, the frequency response of the transducers 10 and 12 approximate their free-space behavior, essentially unaffected by the enclosure volume, except at higher frequencies where enclosure-induced resonances may occur. Normally the front radiations from the sources 10 and 12 will substantially cancel in a plane of symmetry perpendicular to the line joining the sources and are substantially reduced elsewhere compared with that of the same transducers with infinite baffles. Positioning the wearer's head 20 between the two sources allows each ear 16 and 18 to hear a substantial level of sound from the nearest source and much less from the other. Thus the two ears receive signals which are out-of-phase.

Enclosure 14 is either hollow, or filled with an acoustically transparent material. The filling material should not significantly load the transducer diaphragm due to acoustic back pressure. Preferably, an open-cell foam material is employed for this purpose. Whether or not the enclosure should remain empty or be filled, and the selection of the material in which to fill the enclosure, depends on a number of factors. The best choice for a given design will depend on the desired degree of stiffness required, the shape of the enclosure cavity, and additional factors such as the desire for high frequency damping to suppress undesired resonance within the enclosure. In this regard, it is easier to damp high frequencies than lower frequencies and this can be accomplished while at the same time maintaining good acoustic pressure coupling throughout the enclosure at low frequency.

The wall 22 of the enclosure is also made from or covered by a material which is substantially acoustically inert, that is, non-radiative and absorbing. Also, it is preferable that the material forming the wall 22 or outer covering, be flexible and in some cases soft so that it will not irritate the wearer. The material also should be lightweight and inexpensive. Heavy gauge woven impregnated fabrics and carbon fiber composites are two materials which meet these objectives, but other comparable materials could be utilized. High density closed-cell foam tape has been employed successfully in embodiments of these principles.

Figure 2:
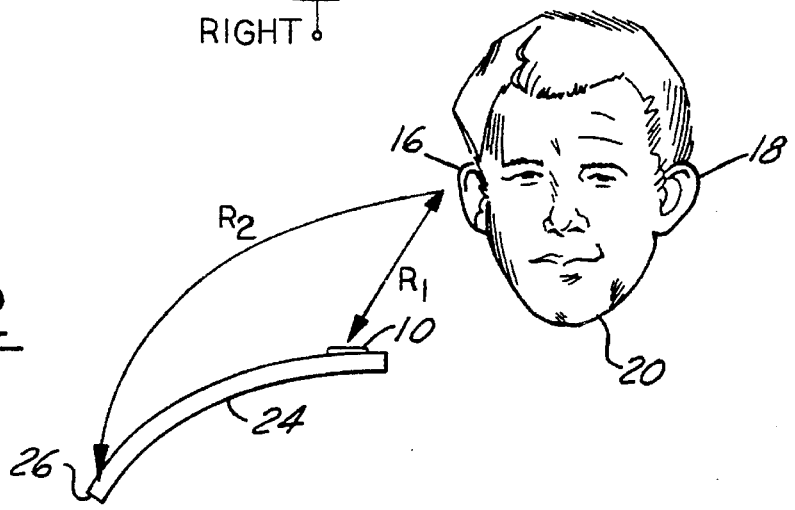
FIG. 2 illustrates the use of a second embodiment of the present invention which utilizes an open ended enclosure.

FIG. 2 illustrates a second preferred embodiment of the invention ("Type II"). This embodiment uses a single transducer 23 in an open, i.e. vented, enclosure 24. Generally, there should be two identical devices, one positioned on either side of the wearer's head adjacent to one of the wearer's ears. Also, for ease of wearing and use, the enclosure 24 preferably conforms to a portion of the wearer's body, such as a shoulder, lapel area or head.

The enclosure 24 is a thin narrow hollow enclosure which is open to the atmosphere at one end 26. The transducer 23 is situated near the ear 16 of the wearer, perhaps on his shoulder or temple, and the open end 26 is positioned as far away from the ear 16 as possible.

It is also possible for the open and closed ends of the enclosure 24 to be reversed if that provides a preferred wearable configuration. In that embodiment, the open end 26 may serve as a primary source.

Tests have shown that "dipole" speakers in accordance with the present invention secure an audio enhancement at low frequencies. Compared with in-phase operation in sealed enclosures, the enhancement is on the order of 16–20 dB for frequencies on the order of 20–160 Hz. At approximately 100–200 Hz, which is close to the normal in-phase turnover frequency for the test enclosure, the sound levels became approximately equal. The in-phase levels exceed those of the out-of-phase situation, that is, the dipole case, at frequencies above that amount.

Certain resonances may occur at higher frequencies because of the finite size of the enclosures. In these embodiments, the resonances can be overcome by splitting the input signal between low and high frequencies with a multi-speaker system. This comprises a "tweeter-woofer" arrangement. In other systems, the entire audio range may be covered with the same transducers. In those situations, it may be necessary to suppress the resonances to a point where they become inaudible. This can be accomplished by selection of an appropriate damping material to partially or completely fill the enclosure, by using shaped vents, or by using electrical equalization of the input signals.

The dipole configuration for wearable speakers also results in reduced radiation at long distances due to the out-of-phase character. This decreases the radiation beyond the wearer's immediate environment, especially at low frequencies which could be annoying to others, compared with in-phase systems.

Figure 3:
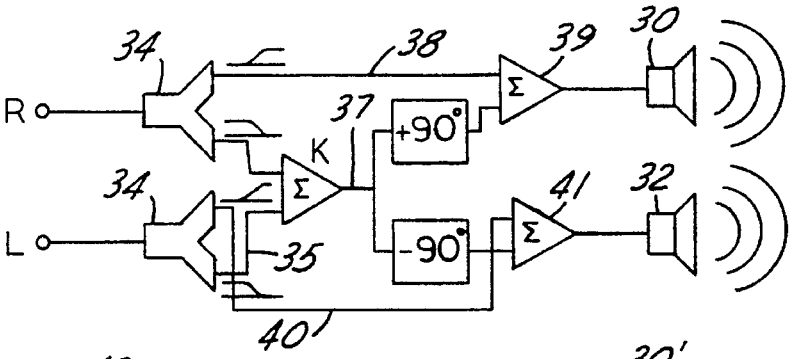
FIGS. 3 and 4 illustrate two filter networks for use with the first embodiment of the present invention.
Figure 4:
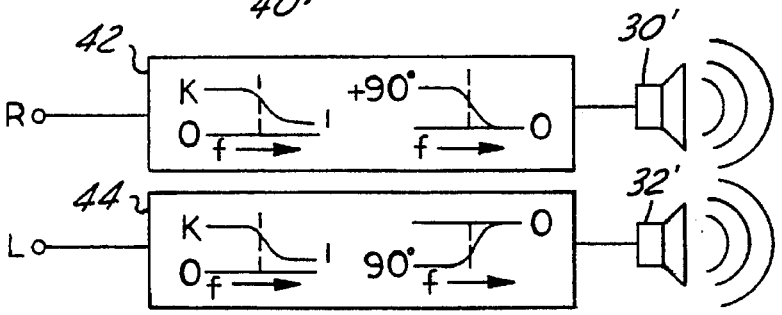

FIGS. 3 and 4 illustrate two proposed filter networks for driving a system incorporating the Type I embodiment of the present invention. In FIG. 3, a stereo pair of wearable dipole speakers 30 and 32 are driven in the dipole out-of-phase mode from the lowest frequencies to the cross-over frequency at which the "out-of-phase" response is nominally equal to the "in-phase" response. The signals for the right "R" and left "L" channels are passed through frequency splitters 34. The low frequency signals 35 from both the R and L channels are passed through summer 36 and multiplied by the gain K. The resultant signal 37 is applied to a +90° phase shifter and a −90° phase shifter. The resultant +90° phase-shifted signal is combined with the high frequency signal 38 at summer 39 for the R channel. The resultant −90° phase-shifted signals combined with high frequency signal 40 at summer 41 for the L channel. The speakers are driven in-phase at higher frequencies with shaped gain compensation to produce a uniform response. The transition shape and phase and gain can be adjusted to yield optimum subjective performance.

The system shown in FIG. 4 is the digital equivalent of the system shown in FIG. 3 and operates in a similar manner to get the same result. The signals for the right "R" and left "L" channels are electronically split in digital processing networks 42 and 44, respectively, into the high frequencies and low frequencies at the cross-over point (which is the resonant frequency of the transducer). The low frequency signals are then driven out-of-phase and combined with the in-phase high frequency signals. The resultant combined signals are then delivered to the speakers 30' and 32'.

The dipole speakers can be positioned on the wearer in a number of different ways. For example, the speakers could be positioned on the collar or upper shoulders of a shirt or other wearable garment. A system having both microphones and speakers in a shirt-type garment is shown in commonly owned co-pending U.S. application Ser. No. 280,185, the disclosure of which is hereby incorporated by reference.

As mentioned above, enhanced low frequency performance is achieved by either using two sources, one for each ear, which share a common sealed enclosure but are driven 180° out-of-phase (Type I), or a single source in an open enclosure where the vent or open end is placed as far as practicable from the ear (Type II). In the first embodiment, the back pressures cancel and the two sources individually behave as though they are mounted in an infinite volume enclosure. In the second embodiment, the transducer is situated near the ear, perhaps on the shoulder, and the open end is positioned as far from the ear as possible. Of course, the two ends may be reversed if that results in a preferred wearable configuration. That is, the open end may serve as the primary source. Typically, the open end source will yield less intensity at higher frequencies as a result of internal absorption. Therefore an additional high frequency transducer ("tweeter") for each ear may be required.

In either of the Type I or Type II embodiments where there are two transducers or a single transducer, the hollow enclosures are preferably designed with a shape and sufficient flexibility that they can be worn on the body in comfort. This conformal "softness" can be secured by filling the enclosure with a physically supporting but acoustically transparent material that will not significantly load the transducer due to acoustic back pressure. As mentioned above, open-cell foam materials have been shown to be satisfactory for this purpose.

FIGS. 5–8 show various arrangements of transducers in accordance with the present invention. These systems meet the requirements for "dipole operation," proximity to the wearer's ears, and mutual coupling between two transducers. Of course, a single transducer, or more than two, may be substituted for the pairs of transducers shown in these Figures.

Also, it is to be understood that the term "transducer" used herein can include arrays of two or more closely coupled transducers substituted for a single transducer in order to obtain increased audio output. Mutual coupling between equi-phased transducers in close proximity increases acoustic radiation efficiency, as is well known.

Figure 5:
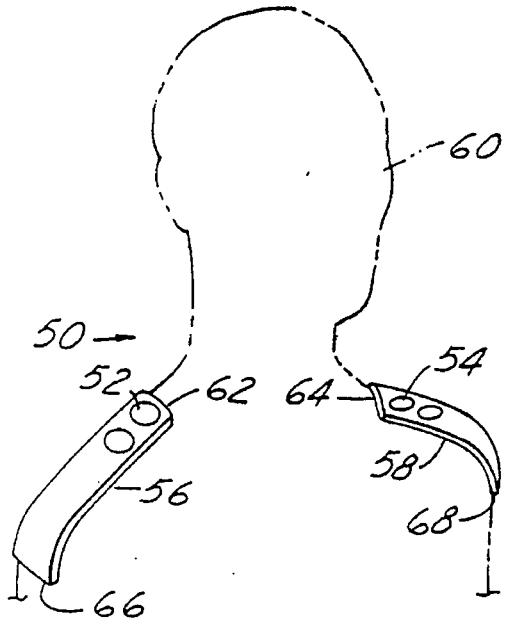
FIGS. 5–8 depict alternate possible wearable embodiments of the present invention.

FIG. 5 shows a Type II system 50 with a pair of "dipole" speakers or transducers 52 and 54. (As shown, each of transducers 52 and 54 comprise an array of two transducers.) The enclosures 56 and 58 are shaped and configured to mount on the shoulders of the wearer 60. The enclosures 56 and 58 are either hollow or filled with an acoustically transparent material as discussed above. Ends 62 and 64 of the enclosures are closed while ends 66 and 68 are open.

Figure 6:
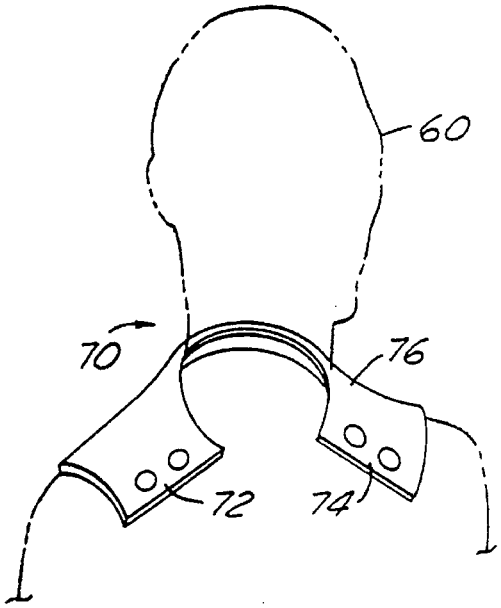

FIG. 6 shows a Type I system 70 utilizing two transducer arrays 72 and 74 mounted in a shared common enclosure 76.

All of the ends or sides of the enclosure 76 are closed (sealed). The enclosure 76 is shaped and configured like a yoke and mounted around the rear of the neck of the wearer 60 with its ends having the transducers 72 and 74 positioned on the shoulders.

Figure 7:
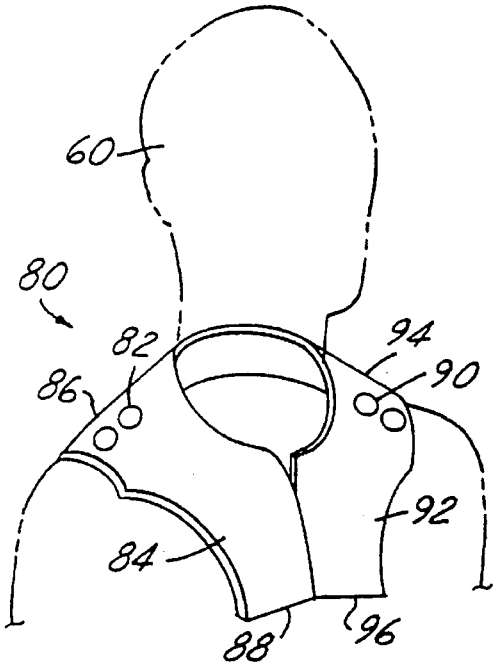
Figure 8:
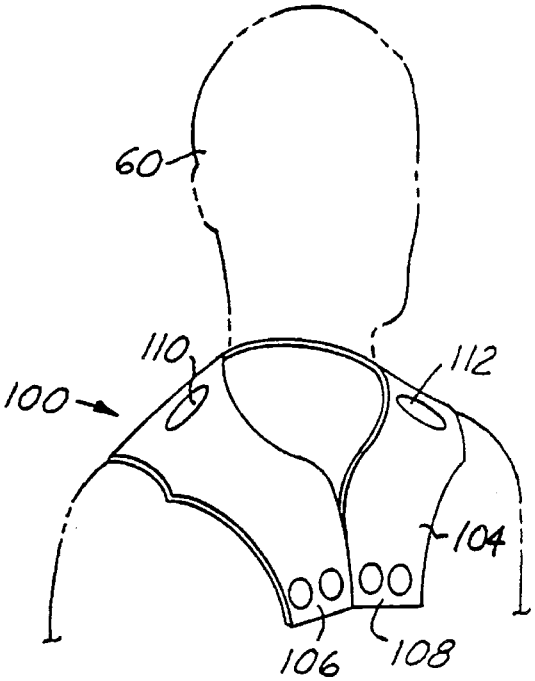

Other Type II systems are shown in FIGS. 7 and 8. In system 80 shown in FIG. 7, transducer array 82 is positioned in enclosure 84 having a closed end 86 at the rear of the wearer and an open end 88 on the lower chest of the wearer. Similarly, transducer array 90 is positioned in enclosure 92 having a closed end 94 and an open end 96. The system 80 is also shaped and configured like a yoke with the transducers on the shoulders of the wearer 60. Again, the enclosures 84, 92 are either hollow or filled with an acoustically transparent material.

In system 100 shown in FIG. 8, separate enclosures 102 and 104 are provided in a yoke-type configuration and are positioned and shaped to fit on the shoulders of the wearer 60. The transducer arrays 106 and 108 are positioned on one end of the enclosures 102 and 104. The enclosures are either hollow or filled with an acoustically transparent material. Rather than having open ends in the enclosures 102 and 104, vents 110 and 112 are provided. The vents are openings in the enclosures and have the same purpose and effect as open ends.

Although FIGS. 5–8 illustrate use of the present invention with a single independent enclosure or a pair of independent enclosures, it is to be understood that the enclosures can be integrated into various types of clothing, such as vests, jackets, shirts, sweatshirts, headbands, hats, helmets, scarfs, shawls or the like. This would make the system more easily wearable and usable by the wearer. The articles of clothing also would hide the transducers and enclosures from view.

In an alternate embodiment, transducers which are selected for optimum low frequency response can be combined with transducers which are better for higher frequencies. This provides improved over-all high fidelity performance. A cross-over network used to divide audio signals into appropriate bands for this purpose is shown in FIG. 9.

Figure 9:
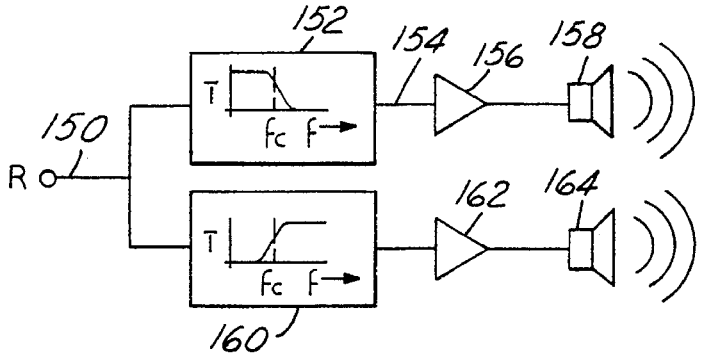
FIG. 9 illustrates a cross-over network for use with the present invention.

In FIG. 9 only the right channel "R" circuit diagram is shown, but it is understood that the circuit diagram for the left channel is identical. The audio signal 150 is fed into low pass filter 152 and the resultant signal 154 is amplified by amplifier 156 and used to drive the right "woofer" speaker 158. At the same time, the signal 150 is passed through high pass filter 160, amplified by amplifier 162 and used to drive the right "tweeter" speaker 164. The filters 152 and 160 can have either an analog or digital implementation.

The connections between the transducers and their power and driving sources may be accomplished by the use of wires or other conventional electrical connection devices. It is also possible to use wireless technology, such as radio frequency, infrared or inductive coupling in order to distribute the signals from audio sources to the transducer drive electronics.

Figure 10:
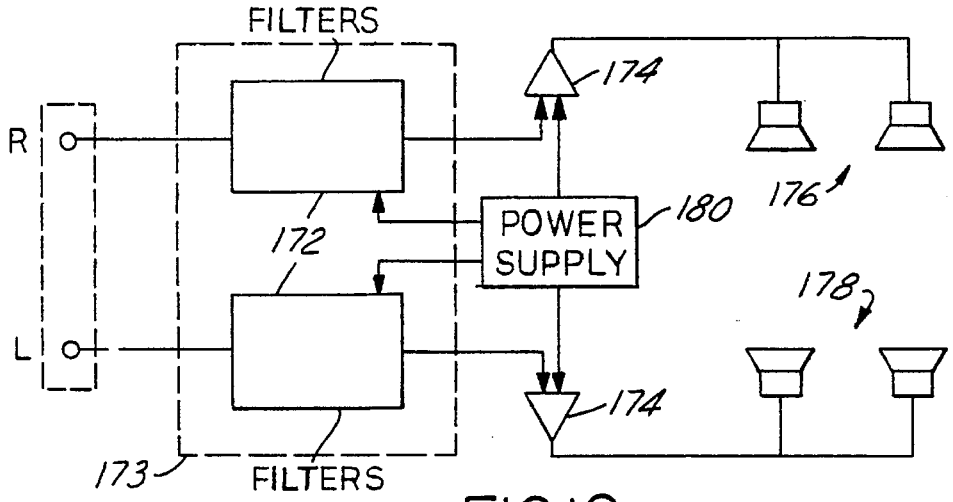
FIG. 10 schematically illustrates one system wherein the electronics are positioned in an enclosure.

The electronic circuitry and batteries for this system can be positioned in the hollow enclosures, in other portions of the wearable garment, or on other portions of the wearer's body. In this regard, complete radio, portable telephone, or cellular telephone systems could be integrated into the hollow enclosures. FIG. 10 is a schematic diagram of a basic system which could be utilized in accordance with the present invention and in which the electronics and other circuitry are mounted in an enclosure.

In FIG. 10, the right "R" and left "L" audio signals are introduced into the system at 170. The signals are then passed through equalization filters and preamplifiers 172 and driven by driver amplifiers 174. The resultant signals are sent to transducer arrays 176 and 178. Power supply 180 supplies the power for the filters, preamps and driver amps. The system shown in FIG. 10 is directed to a Type II embodiment of the invention. For a Type I embodiment, the portion of the system designated by the reference numeral 173 is replaced by the splitter and filter systems shown in FIGS. 3 or 4.

Figure 11:
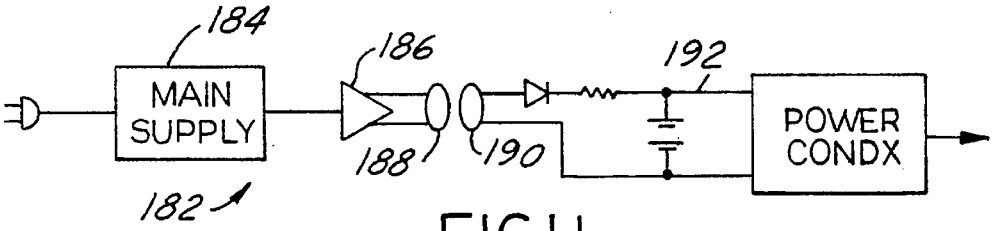
FIG. 11 illustrates an alternate power supply for the present invention.

The power supply 180 can be any one of a variety of conventional types of power supplies conventionally used for portable electronic products today. For example, the power supply could be one or more long life batteries. The power supply also could be a rechargeable battery which uses an inductive charging system 182, such as that shown in FIG. 11. In FIG. 11, the main power supply 184 is passed through a high frequency oscillator 186 and used to establish a charging frequency in coil 188. Receiving coil 190 in the headband or other wearable embodiment charges the battery 192 which in turn supplies power for the system.

Figure 12A:
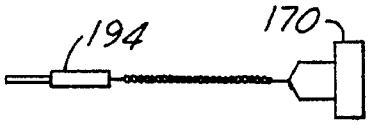
FIGS. 12A and 12B illustrate alternate embodiments for inputting the audio signal into the system.
Figure 12B:
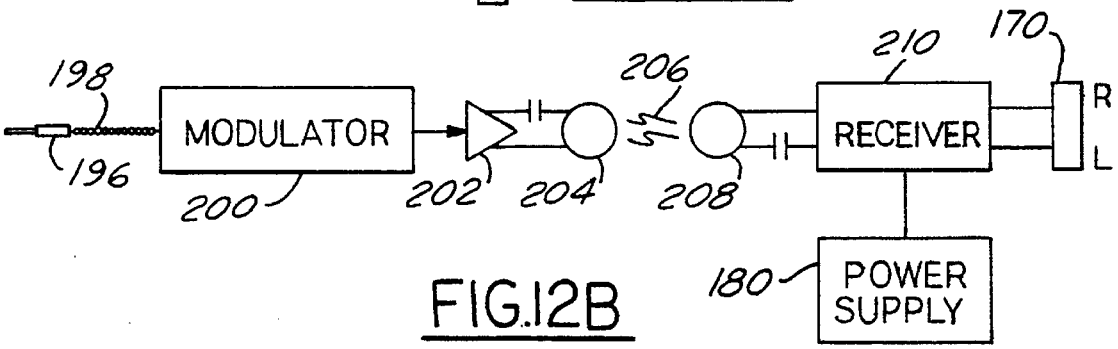

The audio input into the system 170 can be received from a variety of different systems, two of which are shown in FIGS. 12A and 12B. In FIG. 12A the source of the audio input is from a jack member 194 which is hard wired directly to the system 170. The jack member can be connected to an FM radio, a cassette tape player, a cellular telephone, a CD player, or any similar system.

FIG. 12B illustrates a wireless link version of the present invention, where the audio input is secured by inductive coupling. A jack member 196 is plugged into a conventional electronic audio source (such as an AM or FM radio, cassette tape player, CD player, digital audio tape player (DAT), a minidisc player, a digital cassette player (DDC), a portable telephone, a cellular telephone, a portable television, a head-mounted display system etc., or any other conventional communication system) and receives a stereo audio signal 198. The electronic source can be worn at the waist of the wearer, in a pocket, etc. The signal 198 is modulated by stereo FM modulator 200, driven by a radio frequency (RF) driver 202 and transmitted by transmitter wire coupling loop 204. The transmitted signals 206 are received by receiver coupling loop 208 and stereo FM receiver 210, which can be a single integrated circuit (IC). The receiver 210 is driven by power supply 180' which can be any conventional source, as discussed above with reference to power supply 180 (FIG. 10). The carrier for the receiver can be, for example, a 300 kHz carrier. Other methods of transferring signals across or to the body can be utilized, for example infrared and radio frequency systems such as those used in commercially available wireless headphones.

The audio system using the dipole transducer configuration of the present invention, could be controlled in any conventional manner. For example, controls could be mounted directly on the enclosures, or positioned at another site on the wearer connected by wires. One preferred position for placement of the control system is at the wrist of the wearer, either in the cuff of the garment or on a separate wristband, perhaps combined with timekeeping functions, i.e. a watch.

Figure 13:
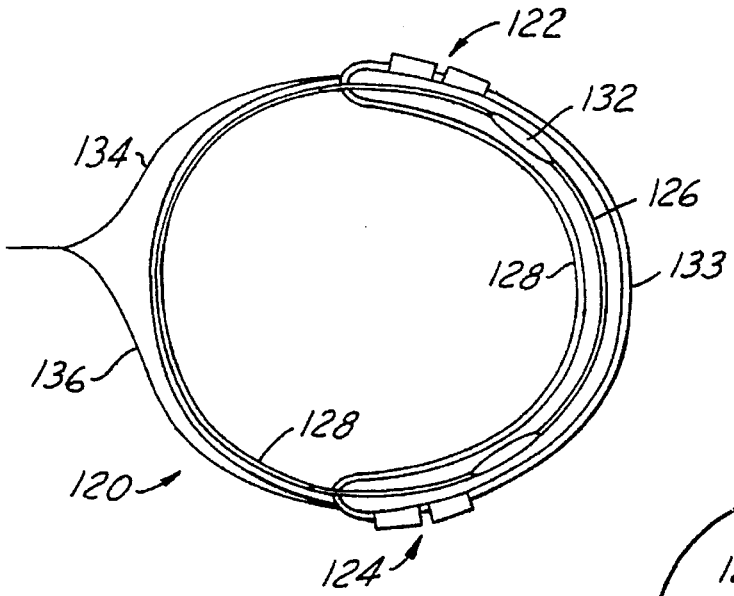
FIG. 13 illustrates an embodiment in which the present invention is incorporated into a headband.

A preferred embodiment for use of the present invention is shown in FIG. 13. The invention is incorporated into a headband 120 and can be used for exercise, sports or any other activity desired.

In FIG. 13, a pair of transducers 122 and 124 are positioned on opposite sides of a headband 120. As set forth above, the transducer arrays could include less or more than a pair of speakers on each side of the headband. The transducers 122, 124 are positioned on opposite ends of an enclosure 126 which is hollow, filled with an open-cell foam, or filled with another acoustically transparent material. For wireless connection to audio sources, an inductive wire loop 128 can be provided around the circumference of the headband. An inductive coil (not shown) could also be provided in the headband, along with a battery or other power source.

Optionally, electronic modules 130, 132 can be provided in the enclosure 126. They can be attached to the inductive loop 128. The electronic modules contain one or more of the circuits described above.

The headband enclosure 126 is preferably covered with a soft or absorbent material 133 on both the inside and outside surfaces. A terry cloth type material 133 provides for absorbing and wicking perspiration from the wearer, This type of material is substantively transparent to the acoustic radiation and could cover the transducers 122–124 if desired for aesthetic reasons.

The transducers 122 and 124 can also be covered with a thin protective material (not shown) if desired. In order to protect the transducers from the moisture and inclement weather, they can be sealed by a thin diaphragm that is substantially acoustically transparent over the audio frequency range.

The transducers 122, 124 are positioned in the headband so that they will be positioned immediately above the ears of the wearer when the headband is worn. Preferably, the speakers or transducers 122, 124 are positioned above or just forward of the entrances of the ear canals of the wearer.

The physical contact between the transducer chamber walls and the wearer's temples promotes direct coupling of low audio frequencies to the head, thus producing an important pleasant subjective effect giving the impression of further extended low frequency response. In fact, head gear such as hats can be designed specifically to enhance this effect by ensuring that the transducer chamber walls snugly contact the temples, with a minimum of intervening fabric or other materials.

As shown, the enclosure portion 126 of the headband 120 is preferably arranged to partially encircle the head and be positioned toward the front of the wearer's head. However, the enclosure may alternatively be arranged toward the back of the head of the wearer, or encompass the entire circular headband.

The speaker enclosure structure with a foam core offers a satisfactory combination of good acoustical parameters, lightweight and conformable characteristics. For a Type I embodiment, the internal coupling between the transducers 122, 124, driven 180° out-of-phase at the two ears at lower frequencies, sets up a "dipole" operation which enhances the low frequency response. Electric drive is preferably accomplished by a network such as those shown in FIGS. 3 and 4.

For a Type II embodiment, the transducers are operated in phase, but the enclosure is divided into two parts, one for each ear. An opening, or vent, is positioned in each part of the enclosure as far as possible from the wearer's ears. For a headband, the furthest points would be at the front center of the forehead of the wearer or at the rear center of the head.

Wires required to connect the transducers to the audio source are preferably arranged to emerge from the headband at a convenient place, preferably just behind the ears or at the back of the head. In FIG. 13, the wires are identified by the numerals 134 and 136.

Preferably, the electronics are encapsulated in the hollow portion of the headband 120 and embedded in the foam material. Power can be supplied to the system by a replaceable battery (not shown). The power can also be supplied by a permanent battery which is charged with a inductive coupler to an external charging supply as is well know. Also, the signal coupling loop could act additionally as a charging coupler by using appropriate filtering to separate signals at different frequencies. A basic circuit diagram for a system which can be used with the present invention is shown in FIG. 10. The system could be powered by the embodiments shown in FIGS. 11, 12A or 12B.

As indicated, the audio signals are applied to the transducers 122, 124 by means of a wire loop 128 embedded in the headband 120. The loop could have multiple turns and be arranged in a resonant circuit for optimum efficiency. The audio source, e.g. a tape player, is connected to a transmitter unit which terminates in another wire loop. Inductive coupling between the two loops creates a signal in the headband which is amplified and demodulated to produce a two-channel stereo signal which is then directed to the transducers. A typical carrier frequency for this system is 300 kHz. FM is the preferred modulation technique, providing inherent immunity to noise.

A headband system similar to that described above could be used for various entertainment and communication functions. Also, the audio system may be set up to report additional functions to the wearer, such as the time of day, pace, heart rate, etc. with a synthesized voice or other audio signal. The headband could also provide appropriate psychological conditioning messages.

Although the sports-related invention is shown and described above with reference to a headband 120, it is obvious that the present invention could be incorporated into other head-mounted wearable members, such as a cap, hat, helmet or the like. Moreover, the headband, hat, etc., could be used by wearers for various activities, other than merely sports or exercise related. For example, construction workers, homeowners, sports spectators and the like could wear one of the devices as a personal entertainment or communication system.

Figure 14:
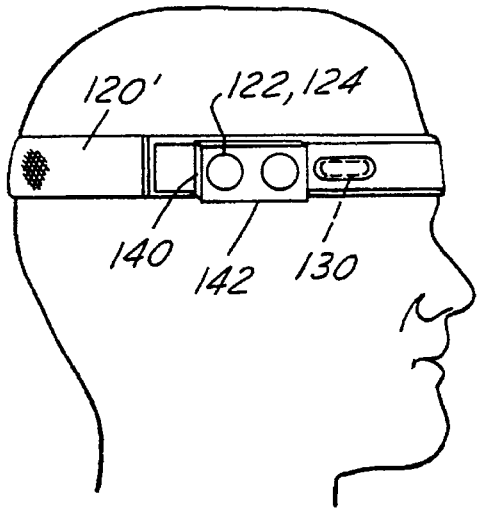
FIG. 14 illustrates an alternate headband embodiment.

As illustrated in FIG. 14, the transducers or speakers 122, 124 are oriented in line with the circumference of the headband 120'. When the headband is worn, much of the radiation is emitted in a direction away from the wearer's ears. In order to improve the audio transmission to the ears, a deflector or concentrator 140, as shown in FIG. 14, could be utilized. The deflector 140 is preferably made from a plastic material, and covers the areas of the speakers 122, 124 except for an opening 142 adjacent the ears of the wearer. For the headband 120' shown in FIG. 14, the opening is positioned downwardly.

In order to provide better bass response at frequencies of typically of 60–80 Hz, it may be desirable to use bass boost or equalization in the system. This drives more electrical power into the speakers or transducers below their effective resonance. Typically, an additional 12 dB boost of power can be used for each octave below resonance. This is known for high-end audio speaker systems.

It also is possible to use multiple transducers adjacent to each of the ears of the wearer. This would increase the bass response limits. The power handling improves proportionally to the number of transducers provided. Also, the mutual acoustic coupling at low frequencies enhances the effective radiation resistance and therefore the output beyond simple additive response. Although FIGS. 13 and 14 show headbands having one pair of transducers on each side of the wearer's head, more than two may be used adjacent each ear.

In order to increase the audio sound level, enhance the bass response, and prevent the sounds from bothering or being heard by others, it is possible to add ear flaps or ear cups of some type which direct the sounds from the transducers to the ears of the wearer. (FIG. 14 shows one form for accomplishing this.) It may be preferable to arrange the flaps or cups to be movable, allowing the wearer to change the degree of isolation from the surroundings.

Figure 15:
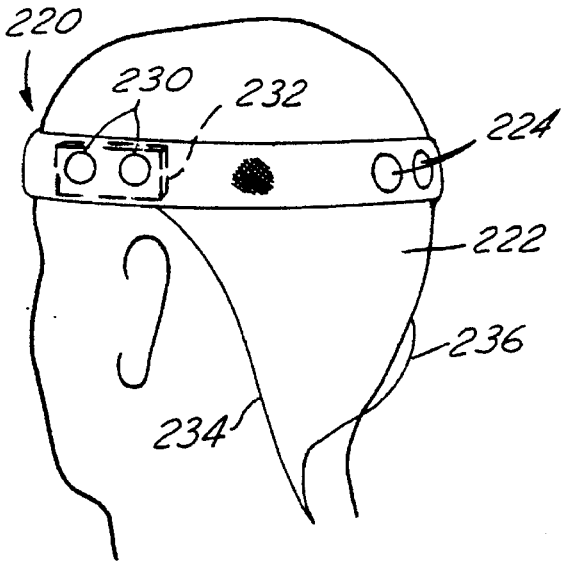
FIG. 15 shows a preferred form of a headband embodiment of the invention.

A headband 220 incorporating a prototype of the present invention was developed and is schematically shown in FIG. 15. In FIG. 15, the headband 220 is oriented on the wearer's head 222 with the back pressure vents 224 facing toward the back. It is also possible to wear the headband so that the vents 224 are oriented toward the front of the wearer's head.

Four 30 mm diameter transducers 230 (two for each ear) are utilized in the headband 220. The transducers used were taken from Sony model MDR-D33 headphones. The measured free-air resonant frequency of the transducers was 180 Hz. The transducers were glued in a Delrin component and encapsulated between two strips of adhesive-backed high density foam tape (3M type 4416). Holes were cut in the foam tape for the transducers. A ⅜" thick open-cell foam core (Atlas Foam Products type A172C) was cut to a width of 1.4" and a length of about 11". The core was encapsulated by the same strips of foam adhesive tape to form a half headband structure (similar to that shown in FIG. 13). A pair of acoustic concentrators 232 were fabricated from Delrin and secured over each set of two speakers.

The speakers were driven in phase directly by wires 234 and 236. Center vents 224 for the speaker back pressures were provided by cutting holes in the tape at a location which was centered near the back (or front) of the head when the headband was worn, i.e. at the furthest point from the ears. Extensions of the band with Velcro-type fasteners secured the two ends of the headband together and also provided adjustment for comfort and different sized heads.

The speakers were driven with a conventional amplifier and a conventional ⅓ octave graphic equalizer adjusted to provide a tapered 12 db of bass boost below 160 Hz, as described above. This prototype yielded satisfactory results which were competitive with high quality headphones. In fact, in some cases, the "sound stage spatialization" sensation was superior to that produced by standard headphones. The pleasant effect of apparent additional low frequency extension due to direct coupling into the temples was also noted.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

It is claimed:

1. A personal wearable, portable communication and entertainment system comprising:

a hollow, closed structural member;

a first transducer means mounted on said structural member;

a second transducer means mounted on said structural member;

said first and second transducer means positioned in spaced relation to each other on said structural member;

driver means for driving said first and second transducer means with driving signals, said first and second transducer means being driven 180 degrees out-of-phase at a first frequency range and being driven in-phase at a second frequency range;

said first frequency range being lower than said second frequency range;

means for supplying audio signals to said first and second transducer means; and means for changing the relative phase of driving signals from said driving means when the out-of-phase response would have been approximately the same as the in-phase response;

whereby the response of said system in said first frequency range is enhanced.

2. The personal wearable, portable communication system of claim 1 wherein said structural member is filled with an acoustically transparent material other than air.

3. The personal wearable, portable communication system of claim 2 wherein said material is an open cell foam.

4. The personal wearable, portable communication system of claim 1 wherein said first and second transducer means each comprise at least one transducer device.

5. The personal wearable, portable communication system of claim 1 wherein said first and second transducer means each comprise at least two transducer devices.

6. The personal wearable, portable communication system of claim 1 wherein said first frequency range comprises about 20–200 Hz.

7. The personal wearable, portable communication system of claim 1 wherein said system is adapted to be worn by a wearer and produces an audio output while not covering the ears of the wearer or blocking environmental sounds to the wearer.

8. The personal wearable, portable communication system of claim 1 wherein said structural member is made from a flexible, pliable material and can be formed to conform to a portion of the wearer's body.

9. The personal wearable, portable communication system of claim 1 wherein said means for supplying audio signals is selected from the group comprising a CD player, radio, digital audio tape player, digital cassette carrier, mini-disc player, telephone, television and cassette tape player.

10. The personal wearable, portable communication system of claim 1 wherein said means for changing the relative phase of driving signals comprises a crossover network and a 180 degree phase shift network.

11. The personal wearable, portable communication system of claim 10 wherein said means for changing the relative phase of driving signals comprises a digital signal processing system.

12. The personal wearable, portable communication system of claim 2 wherein said acoustically transparent material comprises at least in part a high frequency damping material.

13. A personal wearable, portable communication and entertainment system comprising:

a first hollow structural member;

a first transducer means mounted on said first structural member;

said first structural member having a first acoustic aperture in spaced relation to said first transducer means;

a second hollow structural member;

a second transducer means mounted on said second structural member;

said second structural member having a second acoustic aperture in spaced relation to said second transducer means;

driver means for driving said first and second transducer means; and means for supplying audio signals to said first and second transducer means;

whereby when said system is worn with the first transducer means being positioned adjacent, but not blocking or covering one of the wearer's ears, the second transducer means being positioned adjacent but not blocking or covering the other of the wearer's ears; and the first and second apertures each being positioned at a distance further from the wearer's ears than the respective first and second transducers, the system provides a low frequency response which approximates that provided by conventional headphones and earphones that cover the wearer's ears and significantly block external sounds to the ears.

14. The personal wearable, portable communication system of claim 13 wherein said first and second structural members are each filled with an acoustically transparent material other than air.

15. The personal wearable, portable communication system of claim 14, wherein said material is an open cell foam.

16. The personal wearable, portable communication system of claim 13 wherein said first and second transducer means each comprise at least one transducer device.

17. The personal wearable, portable communication system of claim 13 wherein said first and second transducer means each comprise at least two transducer devices.

18. The personal wearable, portable communication system of claim 13 wherein said first and second structural members are each made from a flexible, pliable material and can be formed to conform to a portion of the wearer's body.

19. The personal wearable portable communication system of claim 13 wherein said means for supplying audio signals is selected from the group comprising a CD player, radio, digital audio tape player, digital cassette carrier, mini-disc player, telephone, television and cassette tape player.

20. The personal wearable, portable communication system of claim 14 wherein said acoustically transparent material comprises at least in part a high frequency damping material.

21. The personal wearable, portable communication system of claim 13 wherein said first and second apertures each comprise a vent and said apertures are positioned relative to said first and second transducer means at the furthest possible position on said first and second structural members from a wearer's ears when the system is worn.

22. A personal wearable, portable communication and entertainment system comprising:

a hollow structural member;

first and second transducer means mounted in spaced relation on said structural member;

said structural member having at least one acoustic aperture positioned between said first and second transducer means;

driver means for driving said first and second transducer means;

means for supplying audio signals to said first and second transducer means; and whereby when the system is worn with the first transducer means being positioned adjacent, but not blocking or covering one of the wearer's ears; the second transducer means being positioned adjacent, but not blocking or covering the other of the wearer's ears, and said aperture is positioned farther away from the wearer's ears than said first and second transducer means, the low frequency response of said system approximates that provided by conventional headphones and earphones that cover the wearer's ears and significantly block external sounds to the ears.

23. The personal wearable, portable communication system of claim 22 wherein said structural member is filled with an acoustically transparent material other than air.

24. The personal wearable, portable communication system of claim 23 wherein said material is an open cell foam.

25. The personal wearable, portable communication system of claim 22 wherein said first and second transducer means each comprise at least one transducer device.

26. The personal wearable, portable communication system of claim 22 wherein said first and second transducer means each comprise at least two transducer devices.

27. The personal wearable, portable communication system of claim 22 wherein said structural member is made from a flexible, pliable material and can be formed to conform to a portion of the wearer's body.

28. The personal wearable, portable communication system of claim 22 wherein said means for supplying audio signals is selected from the group comprising a CD player, radio, digital audio tape player, digital cassette carrier, mini-disc player, telephone, television and cassette tape player.

29. The personal wearable, portable communication system of claim 22 wherein at least two apertures are provided in said structural member, one aperture corresponding to said first transducer means and the other aperture corresponding to said second transducer means.

30. The personal wearable, portable communication system of claim 23 wherein said acoustically transparent material comprises at least in part a high frequency damping material.

31. The personal wearable, portable communication system of claim 22 wherein when said system is worn by a wearer, said aperture is positioned further from the wearer's ears than said first and second transducer means.

32. The personal wearable, portable communication system of claim 22 wherein when said system is worn by a wearer, said aperture is positioned closer to the wearer's ears than said first and second transducer means.

33. The personal wearable, portable communication system of claim 44 further comprising additional high frequency transducer means mounted on said structural member adjacent said aperture.

34. A personal wearable, portable communication and entertainment system comprising:

a hollow, closed structural member;

a first transducer means mounted on said structural member;

a second transducer means mounted on said structural member;

said first and second transducer means positioned in spaced relation to each other on said structural member;

driver means for driving said first and second transducer means with driving signals, said first and second transducer means being driven 180 degrees out-of-phase within a first frequency range and being driven in-phase within a second frequency range;

said first frequency range being lower than said second frequency range;

means for supplying audio signals to said first and second transducer means; and means for changing the relative phase of driving signals from said driving means when the out-of-phase response would have been approximately the same as the in-phase response;

said structural member sized to be positioned on a wearer's torso adjacent the head and shaped to conform to the wearer's torso;

wherein said structural member is positioned on the wearer's torso, said first transducer means is positioned adjacent one of the wearer's ears and said second transducer means is positioned adjacent the other of the wearer's ears;

whereby the response of said system in said first frequency range is enhanced.

35. The personal wearable, portable communication and entertainment system of claim 34 wherein said structural member is filled with an acoustically transparent material other than air.

36. The personal wearable, portable communication and entertainment system of claim 35 wherein said material is an open cell foam.

37. The personal wearable, portable communication and entertainment system of claim 34 wherein said first and second transducer means each comprise at least one transducer device.

38. The personal wearable, portable communication and entertainment system of claim 34 wherein said first and second transducer means each comprise at least two transducer devices.

39. The personal wearable, portable communication and entertainment system of claim 34 wherein said first frequency range comprises about 20–200 Hz.

40. The personal wearable, portable communication and entertainment system of claim 34 wherein said structural member is incorporated into an item of clothing adapted to be worn on the torso of the wearer.

41. The personal wearable, portable communication and entertainment system of claim 34 wherein said structural member is made from a flexible, pliable material and can be formed to conform to a portion of the wearer's torso.

42. The personal wearable, portable communication and entertainment system of claim 34 wherein said means for supplying audio signals is selected from the group comprising a CD player, radio, digital audio tape player, digital cassette carrier, mini-disc player, telephone, television and cassette tape player.

43. The personal wearable, portable communication and entertainment system of claim 34 wherein said means for changing the relative phase of driving signals comprises a phase shift means.

44. The personal wearable, portable communication and entertainment system of claim 43 wherein said phase shift means comprises a digital signal processing system.

45. The personal wearable, portable communication and entertainment system of claim 35 wherein said acoustically transparent material comprises at least a portion of a high frequency damping material.

46. The personal wearable, portable communication and entertainment system comprising:

a first hollow structural member;

a first transducer means mounted on said first structural member;

said first structural member having a first acoustic aperture in spaced relation to said first transducer means;

a second hollow structural member;

a second transducer means mounted on said second structural member;

said second structural member having a second acoustic aperture in spaced relation to said second transducer means;

driver means for driving said first and second transducer means; and means for supplying audio signals to said first and second transducer means;

said first and second structural members being sized to be positioned on a wearer's torso adjacent the head and each being shaped to conform to the wearer's torso;

whereby when said system is worn with the first transducer means being positioned on the torso adjacent one of the wearer's ears, the second transducer means being positioned on the torso adjacent the other of the wearer's ears, and the first and second apertures being each positioned farther away from the wearer's ears, the system provides to the wearer a low frequency response which approximates that provided by conventional head phones and ear phones that cover the wearer's ears and significantly block external sounds to the ears.

47. The person wearable, portable communication and entertainment system of claim 46 wherein said first and second structural members are each filled with an acoustically transparent material other than air.

48. The personal wearable, portable communication and entertainment system of claim 47, wherein said material is an open cell foam.

49. The personal wearable, portable communication and entertainment system of claim 46 wherein said first and second transducer means each comprise at least one transducer device.

50. The personal wearable, portable communication and entertainment system of claim 46 wherein said first and second transducer means each comprise at least two transducer devices.

51. The personal wearable, portable communication and entertainment system of claim 46 wherein said first and second structural members are both incorporated into a single item of clothing adapted to be worn on the torso of the wearer.

52. The personal wearable, portable communication and entertainment system of claim 46 wherein said first and second structural members are each made from a flexible, pliable material and can be formed to conform to a portion of the wearer's torso.

53. The personal wearable, portable communication and entertainment system of claim 46 wherein said means for supplying audio signals is selected from the group comprising a CD player, radio, digital audio tape player, digital cassette carrier, mini-disc player, telephone, television and cassette tape player.

54. The personal wearable, portable communication and entertainment system of claim 46 wherein said first and second apertures each comprise a vent and said apertures are positioned relative to said first and second transducer means at the furthest possible positions and said first and second structural members away from a wearer's ears when the system is worn.

55. The personal wearable, portable communication and entertainment system of claim 46 wherein said acoustically transparent material comprises at least a portion of a high frequency damping material.

56. The personal wearable, portable communication and entertainment system comprising:

a hollow structural member;

first and second transducer means mounted in spaced relation on said structural member;

said structural member having at least one acoustic aperture positioned between said first and second transducer means;

driver means for driving said first and second transducer means; and means for supplying audio signals to said first and second transducer means;

said structural member sized to be positioned on a wearer's torso adjacent the head and shaped to conform to the wearer's torso;

wherein when said structural member is positioned on the wearer's torso, said first transducer means is positioned adjacent one of the wearer's ears and said second transducer means is positioned adjacent the other of the wearer's ears;

whereby when the system is worn with the first transducer means being positioned adjacent one of the wearer's ears, the second transducer means being positioned adjacent the other of the wearer's ears, and said apertures is positioned farther away from the wearer's ears than said first and second transducer means, the low frequency response of said system to the wearer approximate that provided by conventional head phones and ear phones.

57. The person wearable, portable communication and entertainment system of claim 56 wherein said structural member is filled with an acoustically transparent material other than air.

58. The personal wearable, portable communication and entertainment system of claim 57 wherein said material is an open cell foam.

59. The personal wearable, portable communication and entertainment system of claim 56 wherein said first and second transducer means each comprise at least one transducer device.

60. The personal wearable, portable communication and entertainment system of claim 56 wherein said first and second transducer means each comprise at least two transducer devices.

61. The personal wearable, portable communication and entertainment system of claim 56 wherein said structural member is incorporated into an item of clothing adapted to be worn on the torso of the wearer.

62. The personal wearable, portable communication and entertainment system of claim 56 wherein said structural member is made from a flexible, pliable material and can be formed to conform to a portion of the wearer's body.

63. The personal wearable, portable communication and entertainment system of claim 56 wherein said means for supplying audio signals is selected from the group comprising a CD player, radio, digital audio tape player, digital cassette carrier, mini-disc player, telephone, television and cassette tape player.

64. The personal wearable, portable communication and entertainment system of claim 56 wherein at least two apertures are provided in said structural member, one aperture corresponding to said first transducer means and the other aperture corresponding to said second transducer means.

65. The personal wearable, portable communication and entertainment system of claim 57 wherein said acoustically transparent material comprises at least in part a high frequency damping material.

66. The personal wearable, portable communication and entertainment system of claim 56 wherein said aperture is positioned closer to the wearer's ears than said first and second transducer means when said system is worn on the wearer's torso.

67. The personal wearable, portable communication system of claim 56 further comprising additional high frequency transducer means mounted on said structural member adjacent said aperture.

68. A personal portable communication device for wearing on the head of the wearer, said device comprising:

a hollow, closed structural member;

means for securing said structural member on the head of a wearer;

a first transducer means mounted on said structural member and positioned to be adjacent one ear of the wearer;

a second transducer means mounted on said structural member and positioned to be adjacent the other ear of the wearer;

driver means for driving said first and second transducer means with driving signals, said first and second transducer means being driven 180 degrees out-of-phase at a first frequency range and being driven in-phase at a second frequency range;

said first frequency range being lower than said second frequency range;

means for supplying audio signals to said first and second transducer means; and means for changing the relative phase of driving signals from said driving means when the out-of-phase response is approximately the same as the in-phase response;

whereby the response of said system in said first frequency range is enhanced.

69. The personal portable communication device of claim 68 wherein said structural member is filled with an acoustically transparent material other than air.

70. The personal portable communication device of claim 69 wherein said material is an open cell foam.

71. The personal portable communication device of claim 68 wherein said first and second transducer means each comprise at least one transducer device.

72. The personal portable communication device of claim 68 wherein said first and second transducer means each comprise at least two transducer devices.

73. The personal portable communication device of claim 68 wherein said first frequency range comprises about 20–200 Hz.

74. The personal portable communication device of claim 68 wherein said device is worn by a wearer, said device produces an audio output while not covering the ears of the wearer or blocking environmental sounds to the wearer.

75. The personal portable communication device of claim 68 wherein said structural member is made from a flexible, pliable material and can be formed to conform to a portion of the wearer's head.

76. The personal portable communication device of claim 68 wherein said means for supplying audio signals is selected from the group comprising a CD player, radio, digital audio tape player, digital cassette carrier, mini-disc player, telephone, televison and cassette tape player.

77. The personal portable communication device of claim 68 wherein said means for changing the relative phase of driving signals comprises a phase shift means.

78. The personal portable communication device of claim 77 wherein said phase shift means comprises a digital signal processing system.

79. The personal portable communication device of claim 68 wherein said acoustically transparent material comprises at least in part a high frequency damping material.

80. The personal portable communication device of claim 68 wherein said structural member is sized to fit around substantially all of the head of the wearer.

81. The personal portable communication device of claim 68 wherein said structural member is incorporated in a headband.

82. The personal portable communication device of claim 68 wherein said structural member is incorporated into a wearable accessory selected from the group comprising a hat, a cap, a helmet, a scarf and a headband.

83. The personal portable communication device of claim 82 wherein said structural member is covered at least by an absorbent material.

84. The personal portable communication device of claim 82 further comprising a pair of acoustic concentrators, one of said concentrators positioned adjacent each of the ears of the wearer.

85. The personal portable communication device of claim 68 further comprising fastening means to secure said device in position for being worn on the head of a wearer.

86. The personal portable communication device of claim 85 wherein said fastening means is selected from the group comprising snap fasteners and hook-and-loop fasteners.

87. A portable device for wearing on the head of a wearer, said device comprising:

first and second hollow structural members incorporated in said device and positioned to lie adjacent opposed portions of the wearer's head when said device is worn;

a first and second transducer means mounted on said first and second structural members, respectively;

said first structural member having a first acoustic aperture in spaced relation to said first transducer means; and said second structural member having a second acoustic aperture in spaced relation to said second transducer means;

driver means for driving said first and second transducer means; and means for supplying audio signals to said first and second transducer means;

whereby when said device is worn on the wearer's head with the first transducer means being positioned adjacent, but not blocking or covering one of the wearer's ears, the second transducer means being positioned adjacent, but not blocking or covering the other of the wearer's ears, and the first and second apertures each being positioned at a distance further from the wearer's ears than the respective first and second transducers, the system provides a low frequency response which approximates that provided by conventional headphones and earphones that cover the wearer's ears and significantly block external sounds to the ears.

88. The personal portable communication device of claim 87 wherein each of said first and second structural members are filled with an acoustically transparent material other than air.

89. The personal portable communication device of claim 88 wherein said material is an open cell foam.

90. The personal portable communication device of claim 87 wherein said first and second transducers means each comprise at least one transducer device.

91. The personal portable communication device of claim 87 wherein said first and second transducer means each comprise at least two transducer devices.

92. The personal portable communication device of claim 86 wherein each of said first and second structural members is made from a flexible, pliable material and can be formed to conform a portion of the wearer's head.

93. The personal portable communication device of claim 87 wherein said means for supplying audio signals is selected from the group comprising a CD player, radio, digital audio tape player, digital cassette carrier, mini-disc player, telephone, television and cassette tape player.

94. The personal portable communication device of claim 88 wherein said acoustically transparent material comprises at least in part a high frequency damping material.

95. The personal portable communication device of claim 87 wherein said first and second structural members are sized to fit together around substantially all of the head of the wearer.

96. The personal portable communication device of claim 87 wherein said first and second structural members are incorporated in a headband.

97. The personal portable communication device of claim 86 wherein said first and second structural members are incorporated into a wearable accessory selected form the group comprising a heat, a cap, a helmet, a scarf and a headband.

98. The personal portable communication device of claim 97 wherein said first and second structural members are each covered at least in part by an absorbent material.

99. The personal portable communication device of claim 97 further comprising a pair of acoustic concentrators, one of said concentrators positioned adjacent each of the ears of the wearer.

100. The personal portable communication device of claim 86 further comprising fastening means to secure said device in position for being worn on the head of a wearer.

101. A person portable device for wearing on the head of a wearer, said device comprising:

a hollow structural member positioned in said device for encircling at least a portion of said wearer's head;

first and second transducer means mounted on said structural member adjacent said first and second ears, respectively, of said wearer;

said structural member having at least one acoustic aperture positioned substantially mid-way between said first and second transducer means;

driver means for driving said first and second transducer means;

means for supplying audio signals to said first and second transducer means; and means for securing said device to the head of the wearer;

whereby when the device is worn on the head of the wearer with the first transducer means being positioned adjacent, but not blocking or covering said first ear of the wearer, the second transducer means being positioned adjacent, but not blocking or covering said second ear of the wearer, and said aperture is positioned farther away from the wearer's ears than said first and second transducer means, the low frequency response of said device approximates that provided by conventional headphones and earphones that cover the wearer's ears and significantly block external sounds to the ears.

102. The personal portable communication device of claim 101 wherein said structural member is filled with an acoustically transparent material other than air.

103. The personal portable communication device of claim 102 wherein said material is an open cell foam.

104. The personal portable communication device of claim 101 wherein said first and second transducer means such comprise at least one transducer device.

105. The personal portable communication device of claim 101 wherein said first and second transducer means each comprise at least two transducer devices.

106. The personal portable communication device of claim 101 wherein said structural ember is made from a flexible, pliable material and can be formed to conform to a portion of the wearer's head.

107. The personal portable communication device of claim 101 wherein said means for supplying audio signals is selected from the group comprising a CD player, radio, digital audio tape player, digital cassette carrier, mini-disc player, telephone, television and cassette tape player.

108. The personal portable communication device of claim 102 wherein said acoustically transparent material comprises at least in part a high frequency damping material.

109. The personal portable communication device of claim 101 wherein said structural member is sized to fit around substantially all of the head of the wearer.

110. The personal portable communication device of claim 101 wherein said structural member is incorporated in a headband.

111. The personal portable communication device of claim 101 wherein said structural member is incorporated into a wearable accessory selected from the group comprising a hat, a cap, a helmet, a scarf and a headband.

112. The personal portable communication device of claim 111 wherein said structural member is covered at least by an absorbent material.

113. The personal portable communication device of claim 111 further comprising a pair of acoustic concentrators, one of said concentrators positioned adjacent each of the ears of the wearer.

114. The personal portable communication device of claim 101 further comprising fastening means to secure said device in position for being worn on the head of a wearer.

* * * * *